US008650924B2

(12) United States Patent
Madern

(10) Patent No.: US 8,650,924 B2
(45) Date of Patent: Feb. 18, 2014

(54) BEARING BLOCK ASSEMBLY AND ROLLING DEVICE PROVIDED WITH SUCH BEARING BLOCK ASSEMBLIES

(76) Inventor: Jean Henry Robert Madern, Abelendreef (NL)

( * ) Notice: Subject to any disclaimer, the term of this patent is extended or adjusted under 35 U.S.C. 154(b) by 234 days.

(21) Appl. No.: 13/177,932

(22) Filed: Jul. 7, 2011

(65) Prior Publication Data

US 2012/0006653 A1 Jan. 12, 2012

(30) Foreign Application Priority Data

Jul. 7, 2010 (NL) ..... 2005046

(51) Int. Cl.
*B21B 29/00* (2006.01)

(52) U.S. Cl.
USPC ..... 72/246; 271/274; 193/37; 384/419

(58) Field of Classification Search
USPC ..... 74/237, 244, 246; 271/272, 274; 384/252, 418, 419; 193/35 B, 37; 198/622, 624, 782; 72/237, 244, 246
See application file for complete search history.

(56) References Cited

U.S. PATENT DOCUMENTS

| | | | | |
|---|---|---|---|---|
| 679,413 | A | 7/1901 | Bunker | |
| 770,950 | A | 9/1904 | Bailey | |
| 2,785,021 | A | 3/1957 | Whittum | |
| 4,350,555 | A * | 9/1982 | Popoff | 156/540 |
| 4,958,195 | A * | 9/1990 | Firth et al. | 399/332 |
| 4,991,420 | A * | 2/1991 | Frischknecht et al. | 72/244 |
| 5,030,025 | A * | 7/1991 | Mitcham et al. | 400/636 |
| 5,083,488 | A * | 1/1992 | Stanley et al. | 83/344 |
| 5,090,224 | A * | 2/1992 | Svagr et al. | 72/14.4 |
| 5,119,727 | A * | 6/1992 | Miyamoto et al. | 101/352.05 |
| 5,385,088 | A * | 1/1995 | Grabscheid | 100/168 |
| 5,405,486 | A * | 4/1995 | Sablotsky et al. | 156/510 |
| 5,896,771 | A * | 4/1999 | Muller et al. | 72/237 |
| 6,112,569 | A * | 9/2000 | Ossendorf | 72/241.8 |
| 6,817,611 | B2 * | 11/2004 | DiRamio | 271/273 |
| 7,334,446 | B1 * | 2/2008 | Bauder | 72/197 |
| 7,367,171 | B2 * | 5/2008 | Bertram et al. | 53/551 |
| 7,895,871 | B2 * | 3/2011 | Zieser et al. | 72/245 |
| 8,041,272 | B2 * | 10/2011 | Nedelin | 399/297 |
| 8,348,273 | B2 * | 1/2013 | Gayne et al. | 271/273 |

FOREIGN PATENT DOCUMENTS

| | | |
|---|---|---|
| DE | 40 34 796 A1 | 5/1992 |
| EP | 2 105 531 A1 | 9/2009 |

OTHER PUBLICATIONS

Dutch Search Report, dated Mar. 10, 2011, from corresponding Dutch application.

* cited by examiner

*Primary Examiner* — Douglas Hess
(74) *Attorney, Agent, or Firm* — Young & Thompson

(57) ABSTRACT

A bearing block assembly for bearing a pair of rollers which enclose a nip, at one end of the pair, includes two bearing blocks, each of which is intended for bearing a respective roller and which are provided with supporting elements for supporting in a frame. The bearing blocks each have a bearing aperture with a center line or axis, support elements via which the bearing blocks are supported next to one another in such that the center lines or axes of the bearing apertures extend parallel and at a distance from one another, as well as adjusting element via which the mutual distance between the center lines or axes can be adjusted. The support elements include a spring structure which is situated between the bearing blocks and cooperates with both bearing blocks and which is elastically deformable during adjustment of the mutual distance between the center lines or axes.

19 Claims, 3 Drawing Sheets

BEARING BLOCK ASSEMBLY AND ROLLING DEVICE PROVIDED WITH SUCH BEARING BLOCK ASSEMBLIES

The invention relates to a bearing block assembly for bearing a pair of rollers which enclose a nip, at one end of said pair, comprising two bearing blocks, each of which is intended for bearing a respective roller and which are provided with supporting elements for supporting in a frame, which bearing blocks each have a bearing aperture with a centre line or axis, support means by means of which the bearing blocks are supported next to one another in such a manner that the centre lines or axes of the bearing apertures extend parallel and at a distance from one another, as well as adjusting means by means of which the mutual distance between the centre lines or axes can be adjusted.

Such a bearing block assembly is known, inter alia, from DE-A-4034796. The bearing blocks thereof each have a rolling bearing by means of which an end of a roller is rotatably supported. The bearing blocks of each bearing assembly can be adjusted with respect to one another by moving them closer together or further apart. As a result thereof, the gap or nip between the rollers can be adjusted. In this case, the reliefs on the rollers in the form of elevations and/or depressions are at such a distance with respect to one another that the desired operation on a strip of material can be carried out, such as providing ridges, cuts or other surface structures.

With a view to ensuring the desired accuracy of such structures, it has to be possible to adjust and fix the rollers, and thus the bearing blocks, accurately with respect to one another. According to the prior art, as known from DE-A-4034796, this is achieved by means of an eccentric mechanism by means of which one of the rollers is suspended in a bearing block. It is also known, for example, to use screw spindles or hydraulic adjustment devices and tensioning devices, respectively. Such adjustment devices are relatively expensive; in addition, handling the bearing blocks and fixing them in the final position is labour-intensive.

It is therefore an object of the invention to provide a bearing block assembly of the abovementioned type which is simpler to use and which can nevertheless also ensure the desired accurate position of the rollers with respect to one another. This object is achieved by the fact that the support means comprise a spring structure which is situated between the bearing blocks and which cooperates with both bearing blocks and which is elastically deformable during adjustment of the mutual distance between the centre lines or axes.

With the bearing block assembly according to the invention, the bearing blocks t are connected to one another by the elastic structure or spring structure. This elastic structure may form an integral part of the bearing blocks, such as for example obtained by treating a block-shaped or plate-shaped metal material. However, the elastic structure can also be welded onto the bearing blocks in order to form an integral part thereof. A significant advantage of such an embodiment in a single entity of the bearing blocks is the greater stability thereof compared to two separate, mechanically coupled bearing blocks as was customary. The production of the bearing blocks, in particular the bearing apertures thereof, can also be accurately carried out very accurately in such a manner that the mutual position thereof can be accurately established. A further advantage is the fact that fewer components are required in order to produce the bearing block assembly, resulting in lower costs.

In addition, according to a further alternative, the elastic structure can be rigidly connected to both bearing blocks, for example by means of bolt connections. Combinations of such embodiments are also possible, such as an elastic structure which is formed as a single part with one of the bearing blocks from one and the same body and which is rigidly connected to the other bearing block by welding or a bolt connection and the like. Furthermore, a combination of a welded connection and a rigid bolt connection is possible.

Preferably, it is provided that the bearing blocks and the elastic structure all form part of an integrally formed bearing body which is made from metal material and which, in the area situated between the bearing apertures thereof, comprises slots which open on opposite surfaces, viewed in the direction of the centre lines or axes, of the bearing body. In this case, the slots are formed and positioned in such a manner that they enclose one or more leaf springs which provide the desired elasticity. The metal material is preferably steel, but other materials, such as aluminium, can also be used for the bearing body.

The elastic structure can be configured in different ways by providing apertures which extend through the entire thickness of the bearing body, between the opposite main surfaces thereof, viewed in the direction of the centre lines or axes. In this connection, preferably several mutually overlapping slots are provided. In particular, the slots can open on a side, viewed in the direction at right angles to the centre lines or axes, of the bearing body. Preferably, there are two mutually separate slots, one of which opens on one side and the other opens on the other side, viewed in the direction at right angles to the centre lines or axes, of the bearing body in the central area thereof. These slots, each of which opens on one side of the bearing block, are preferably in line with one another and may be separated by a wall.

According to a particularly preferred embodiment, there is at least one central slot which overlaps the slots opening on both sides of the bearing body, which central slot is completely enclosed by the bearing body, viewed in the direction at right angles to the centre lines or axes. By means of such an assembly of continuous slots, an elastic leaf spring is as it were formed in the area between both bearing apertures of the bearing body which elastic leaf spring is elastically deformed when adjusting the mutual position of the bearing blocks. Due to the stiffness of the leaf spring in the direction parallel to the slots and/or in the direction from the one exit to the opposite exit of the slots, the stability of the bearing blocks with respect to one another is guaranteed. In those directions, the stiffness is relatively high, as the leaf spring only provides flexibility in that direction which is directed from the one bearing block to the other. Furthermore, the torsional stiffness of this embodiment of the bearing block assembly is high, about an axis at right angles to the two centre lines or axes and situated in the plane defined by said lines.

A particularly simple embodiment is obtained if the slots are all straight and mutually parallel. In particular, the two slots opening on the sides may be equal in length. A reliable and uniform possibility of adjusting the mutual distance of the bearing blocks is achieved if the pattern as determined by the slots is symmetrical with respect to a plane of symmetry which coincides with the two centre lines or axes.

With a view to adjusting the mutual distance of the bearing blocks with respect to one another, the support means may comprise an adjustment mechanism which cooperates with at least one of the slots for adjusting the mutual position of the bearing blocks while elastically deforming the elastic structure. Said adjustment mechanism may, for example, be configured as an eccentric which is situated in a slot and is adjustable in order to influence the width of the slot.

After the width of the slot has been adjusted, the resulting mutual distance between the bearing blocks can be established. In this connection, the support means may comprise a locking by means of which the bearing blocks can be locked at a set mutual distance with respect to one another. For example, the locking means may comprise at least one filling element which is situated in a slot. The filling elements may have different thicknesses or may also have several filling elements which together have a desired thickness and are used to lock the mutual distance between the bearing blocks.

In this case, it is furthermore possible to ensure that the set position is maintained by pushing the bearing blocks in the direction towards one another. In this connection, at least one clamping element may be present for keeping the bearing blocks pushed towards one another while clamping the at least one filling element.

The bearing blocks of a known configuration may be suspended in the frame of a machine using suspension means intended for the purpose. The bearing block assembly according to the invention may be used accordingly in such a machine, as long as it has also been provided with such suspension means.

In general, the bearing block assembly can also be characterized by means of the elastic properties thereof in an orthogonal coordinate system. The bearing block assembly is then determined by a coordinate system, the x axis of which runs parallel to the centre lines or axes, the z axis runs at right angles to both axes and is in a plane through or parallel to said centre lines or axes, and the y axis runs at right angles to the x axis and the z axis, wherein the spring structure is relatively elastic regarding mutual displacements of the bearing blocks with respect to one another according to the z axis and regarding rotations of both bearing blocks with respect to one another about the x axis and the y axis, and wherein the spring structure is relatively stiff according to mutual rotations of the bearing blocks with respect to one another according to the z axis and regarding displacements of the bearing blocks with respect to one another according to the x axis and the y axis. The invention furthermore relates to a bearing body for the above-described bearing block assembly. In addition, the invention relates to a machine for treating a strip of material, such as cardboard and the like, comprising a frame having two spaced-apart positioning locations for a bearing block assembly as well as a bearing block assembly at each positioning location, the suspension means of which cooperate with supports on the respective positioning location.

Next, the invention will be explained in more detail with reference to an exemplary embodiment, illustrated in the figures, of the bearing block assembly, the bearing body and a rolling machine comprising such bearing block assemblies.

Figure 1:
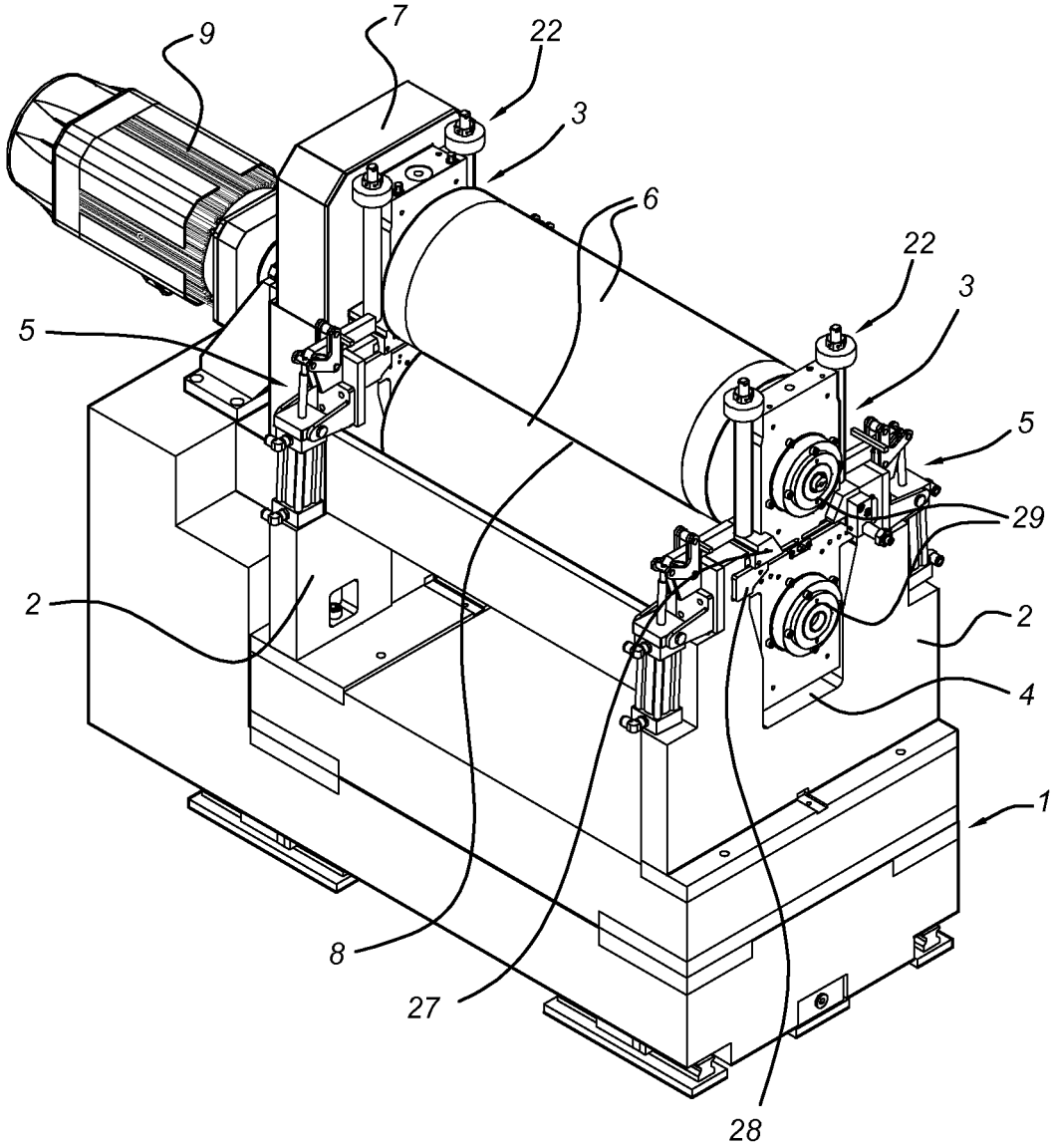
FIG. 1 shows a machine with rollers which are supported at both ends by bearing block assemblies according to the invention.

The machine illustrated in FIG. 1 consists of a frame 1 known per se, onto which two holders 2 are arranged in each of which a bearing block assembly 3 according to the invention is accommodated. To this end, the holders 2 have a slot 4 which is open at the top and securing means 5 by means of which each bearing block assembly is secured with respect to the respective holder 2. In the position illustrated in FIG. 1, the securing means 5 are active, so that the bearing blocks are fixed in the machine. However, the securing means 5 can be moved into an inactive position (not illustrated), so that the bearing block assembly 3, as well as the rollers 6 accommodated therein via the bearings 29, can be removed in an upward direction.

At one end of the rollers 6, the gearbox 7 is located, via which the rollers 6 can be driven in the opposite direction at an even speed of revolution, so that a strip of material (not shown) can be passed through the nip 8 between the rollers 6. The rollers 6 may be provided with reliefs and depressions (not shown) in connection with providing ridges, cuts and the like in the strip of material. The electric motor 9 serves to drive the rollers 6 via the gearbox 7.

Figure 3:
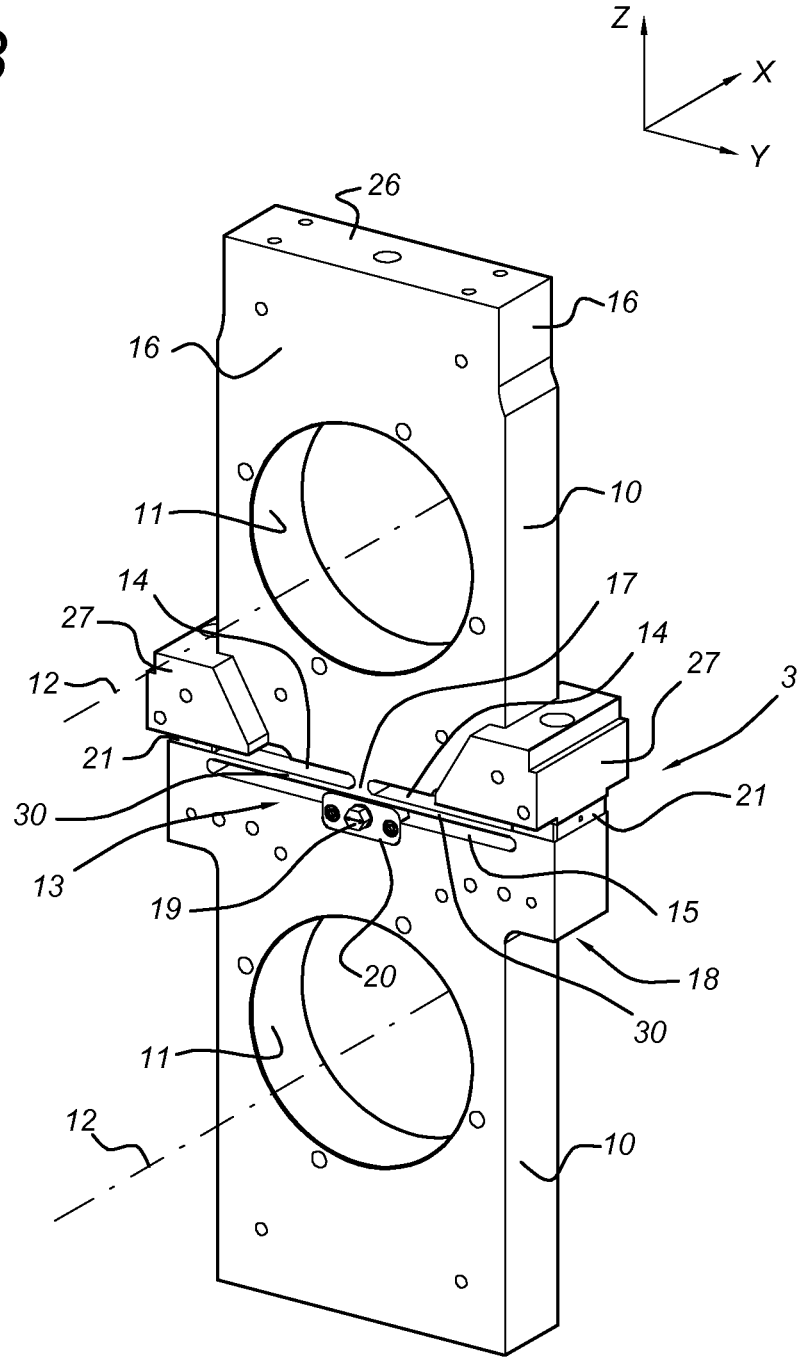
FIG. 3 shows a bearing block assembly.

As mentioned above, the rollers 6 are each supported in a bearing block assembly 3 which is shown on a larger scale in FIG. 3. The bearing block assembly consists of two bearing blocks 10, each provided with a circular hole 11 which can accommodate a bearing 29 for supporting respective rollers 6. The holes 11 have mutually parallel, spaced-apart axes 12 which coincide with the axes of the rollers 6 to be suspended. The bearing blocks 10 are joined to one another by the elastic structure 13. This elastic structure 13 is integral with both bearing blocks 10 and is obtained by providing the slots 14, 15 in a starting material, for example a block-shaped or plate-shaped piece of metal material. Between the slots 14, 15, one or more elastic elements 30 are formed which can be characterized as leaf springs 30.

The illustrated exemplary embodiment comprises two different types of slots. The slots 14 are separated by a wall 17, and open on opposite transverse sides of the bearing block assembly 3. In addition, the slots 14 are in line with one another. A central slot 15 which does not open on one of the transverse sides extends parallel thereto and is closed on all sides. However, all slots 14, 15 open on the opposite main surfaces 16 of the bearing block assembly 3. Although the illustrated exemplary embodiment shows a total of three slots, different numbers of slots are also possible.

The bearing body 18, which does not comprise more than the integrally formed bearing blocks 10 and the elastic structure 13, is part of the bearing block assembly. In the slot 15, in particular in the recessed portion 19 thereof, an eccentric 20 is present by means of which the width of the slot, viewed in the direction from the one axis to the other axis, can be adjusted in which case the leaf springs 30 are then bent. As a result of this setting of the width of the slot 15, the upper boundary thereof will become more or less convex, as a result of which the width of the slots 14, in particular on the opening ends thereof, is also affected. By operating the eccentric 20 in the desired manner, the mutual distance between the axes 12 can be influenced, which results in the fact that the magnitude of the nip 8 between the rollers can be adjusted.

Figure 2:
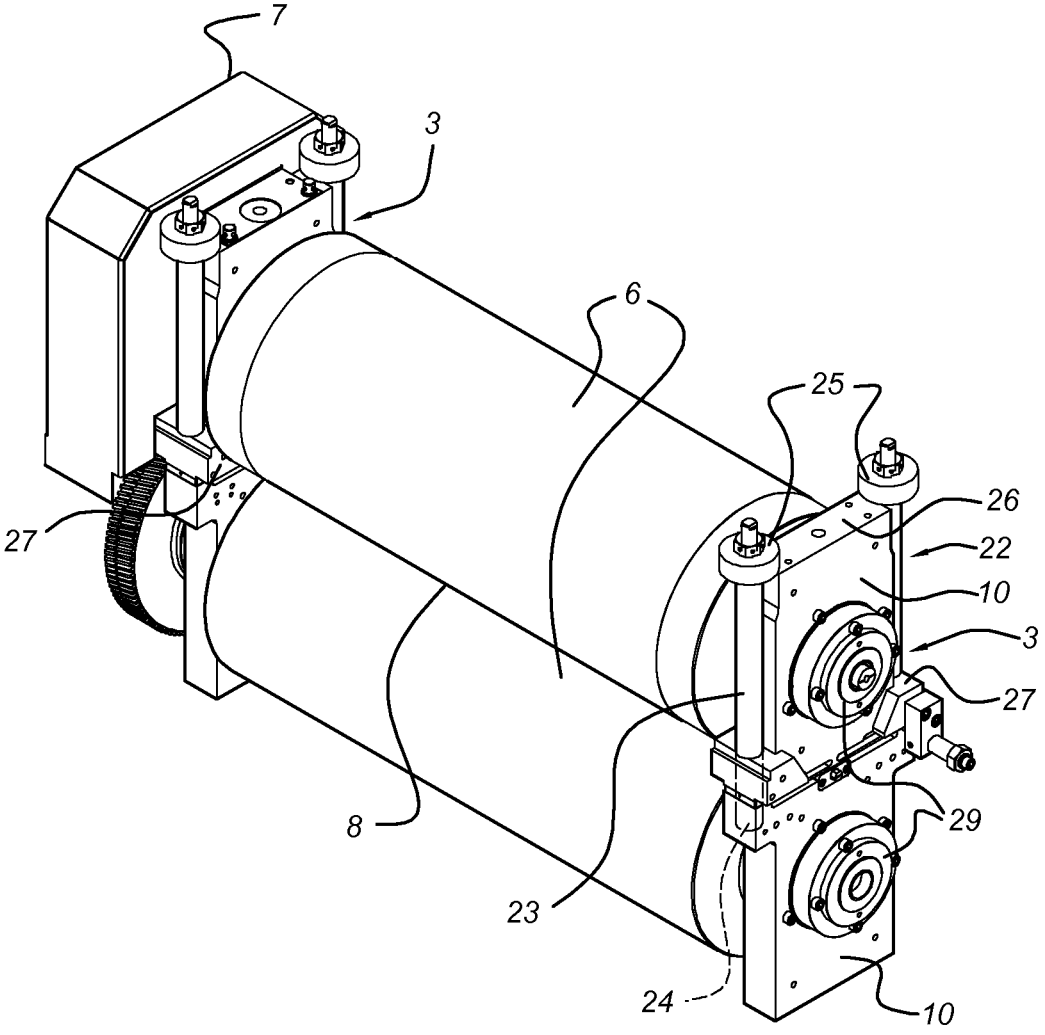
FIG. 2 shows a pair of rollers with bearing block assemblies according to the invention at both ends.

After the width of the slots 14, 15 has thus been adjusted with a view to achieving the desired size of the slot 8, the filling means 21 are placed in the slots 14. Said filling means ensure that the mutual distance between the axes 12 is maintained, even when the eccentric 20 returns to its rest position. With a view to establishing and fixing this position of the bearing blocks 10 with respect to one another, the clamping means 22 illustrated in FIGS. 1 and 2 can be fitted. These clamping means consist of a draw bar 23, the bottom end of which is secured to the bottom bearing block 10 by means of a screw connection 24 (not shown). The head 25 of the clamping means 22 is mounted on the top side 26 of the top bearing block 10. On either side, the top bearing block 10 has a shoulder 27 which, as is illustrated in FIG. 1, rests on a support 28 of the respective holder 2.

In the above, an embodiment has been described in which the bearing block assembly is mounted by means of a shoulder 27. However, the bearing block assembly according to the invention can also be accommodated in the machine in another way, without the use of such a shoulder. Thus, the bearing block assembly can, for example by means of the bottom bearing block, be securely anchored to the frame of the machine.

The bearing block assembly according to the invention can also be characterized by its mechanical properties with respect to the orthogonal coordinate system with x, y and z axes, as is illustrated in FIG. 3. The x axis thereof runs parallel to the centre lines or axes 12. The z axis is at right angles to that at the centre lines or axes 12, and is situated in a plane which passes through or runs parallel to said centre lines or axes 12. The y axis is at right angles to the x axis and the z axis. The elastic structure of the bearing block assembly is chosen such that displacements of the bearing blocks 10 with respect to one another according to the z axis are possible as a result of the relative elasticity of the elastic structure in said direction. The same applies to rotations of the bearing blocks 10 with respect to one another about the x axis and the y axis. By contrast, rotations of the bearing blocks with respect to one another about the z axis are substantially suppressed due to the great stiffness of the elastic structure in this direction. The same applies to displacements of the bearing blocks 10 with respect to one another in the direction of the x axis and the y axis.

LIST OF REFERENCE NUMERALS

1. Machine
2. Holder
3. Bearing block assembly
4. Opening in holder
5. Securing means
6. Roller
7. Gearbox
8. Nip between rollers
9. Electric motor
10. Bearing block
11. Hole in bearing block
12. Axis
13. Elastic structure
14. Opening slot
15. Slot closed on all sides
16. Bearing block assembly main surface
17. Wall
18. Bearing body
19. Aperture in slot closed on all sides
20. Eccentric
21. Filler piece
22. Clamping means
23. Draw bar of clamping means
24. Screw connection of clamping means
25. Head of clamping means
26. Bearing block assembly top surface
27. Shoulder
28. Shoulder mount
29. Bearing
30. Leaf spring

The invention claimed is:

1. Bearing block assembly (3) for bearing a pair of rollers (6) which enclose a nip (8), at one end of said pair, comprising two bearing blocks (10), each of which is intended for bearing a respective roller (6) and which are provided with supporting elements (27) for supporting in a frame (1, 2, 4, 28), which bearing blocks (10) each have a bearing aperture (11) with a centre line or axis (12), support means (13-17) by means of which the bearing blocks (10) are supported next to one another in such a manner that the centre lines or axes (12) of the bearing apertures (11) extend parallel and at a distance from one another, as well as adjusting means by means of which the mutual distance between the centre lines or axes can be adjusted, wherein the support means comprise a spring structure (13, 30) which is situated between the bearing blocks (10) and which cooperates with both bearing blocks (10) and which is elastically deformable during adjustment of the mutual distance between the centre lines or axes (12), and wherein the bearing blocks (10) and the spring structure (13, 30) form part of an integrally formed bearing body (18) which is made from metal material and which, in the area situated between the bearing apertures (11) thereof, comprises slots (14, 15) which open on opposite surfaces (16), viewed in the direction of the centre lines or axes (12), of the bearing body (18), which slots (14, 15) enclose at least one leaf spring (30).

2. Bearing block assembly (3) according to claim 1, wherein several mutually overlapping slots (14, 15) are provided.

3. Bearing block assembly (3) according to claim 2, wherein the support means comprise a locking (21) by means of which the bearing blocks (10) can be locked at a set mutual distance with respect to one another.

4. Bearing block assembly (3) according to claim 3, wherein the locking means comprise at least one filling element (21) which is situated in a slot (14).

5. Bearing block assembly (3) according to claim 4, wherein at least one clamping element (22) is provided for keeping the bearing blocks (10) pushed towards one another while clamping the at least one filling element (21).

6. Bearing block assembly (3) according to claim 2, wherein the slots (14, 15) are all straight and mutually parallel.

7. Bearing block assembly (3) according to claim 1, wherein at least one of the slots (14) opens on a side, viewed in the direction transverse with respect to the centre lines or axes, of the bearing body (18).

8. Bearing block assembly (3) according to claim 7, wherein two mutually separate slots (14) are provided, one of which opens on the one side and the other opens on the other side, viewed in the direction transverse with respect to the centre lines or axes (12), of the bearing body (18) in the central area thereof.

9. Bearing block assembly (3) according to claim 8, wherein the slots (14) each of which opens on a side of the bearing body (18) are in line with one another and are separated by a wall (17).

10. Bearing block assembly (3) according to claim 8, wherein at least one central slot (15) is provided which overlaps the slots (14) opening on both sides of the bearing body (18), which central slot is completely enclosed by the bearing body, viewed in the direction transverse with respect to the centre lines or axes (12).

11. Bearing block assembly (3) according to claim 10, wherein the slots (14, 15) are all straight and mutually parallel.

12. Bearing block assembly (3) according to claim 11, wherein the two slots (14) opening on the sides are equal in length.

13. Bearing block assembly (3) according to claim 2, wherein a pattern as determined by the slots (14, 15) is symmetrical with respect to a plane of symmetry which coincides with the two centre lines or axes (12).

14. Bearing block assembly (3) according to claim 1, wherein the support means comprise an adjustment mechanism (20) which cooperates with at least one (15) of the slots in order to adjust the mutual position of the bearing blocks (10) while elastically deforming the elastic structure (13).

15. Bearing block assembly (3) according to claim 14, wherein the adjustment mechanism comprises an eccentric (20) which is situated in a slot (15) and is adjustable in order to influence the width of the slot (15).

16. Bearing block assembly (3) according to claim 1, wherein the nominal direction of the centre lines or axes (12) is horizontal and a top one of bearing blocks is provided with suspension means (27) intended to cooperate with a machine (1) in which the rollers (6) can be accommodated.

17. Machine (1) for treating a strip of material, such as cardboard, comprising a frame having two spaced-apart positioning locations (2, 4, 28) for a bearing block assembly (3) according to claim 16, as well as a bearing block assembly (3) at each positioning location, the suspension means (27) of which cooperate with the respective positioning location.

18. Bearing block assembly according to claim 1, wherein a coordinate system is determined, the x axis of which runs parallel to the centre lines or axes, the z axis runs at right angles to both axes and is in a plane through or parallel to said centre lines or axes, and the y axis runs at right angles to the x axis and the z axis, wherein the spring structure is relatively elastic regarding mutual displacements of the bearing blocks with respect to one another according to the z axis and regarding rotations of both bearing blocks with respect to one another about the x axis and the y axis, and wherein the spring structure is relatively stiff according to mutual rotations of the bearing blocks with respect to one another according to the z axis and regarding displacements of the bearing blocks with respect to one another according to the x axis and the y axis.

19. Bearing body (18) for a bearing block assembly (3) according to claim 1, said bearing body comprising two bearing blocks (10), each of which is intended for bearing a respective roller (6) and which are provided with supporting elements (27) for supporting in a frame (1, 2, 4, 28), which bearing blocks (10) each have a bearing aperture (11) with a centre line or axis (12), support means (13-17) by means of which the bearing blocks (10) are supported next to one another in such a manner that the centre lines or axes (12) of the bearing apertures (11) extend parallel and at a distance from one another, wherein the support means comprise a spring structure (13, 30) which is situated between the bearing blocks (10) and which cooperates with both bearing blocks (10) and which is elastically deformable during adjustment of the mutual distance between the centre lines or axes (12), wherein the bearing blocks (10) and the spring structure (13, 30) form an integrally part of the bearing body (18) which is made from metal material and which, in the area situated between the bearing apertures (11) thereof, comprises slots (14, 15) which open on opposite surfaces (16), viewed in the direction of the centre lines or axes (12), of the bearing body (18), which slots (14, 15) enclose at least one leaf spring (30).

* * * * *